US008997986B2

(12) United States Patent
Spivey, Sr.

(10) Patent No.: US 8,997,986 B2
(45) Date of Patent: Apr. 7, 2015

(54) CARRIER WITH RETENTION FEATURES

(75) Inventor: Raymond R. Spivey, Sr., Mableton, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 232 days.

(21) Appl. No.: 13/469,438

(22) Filed: May 11, 2012

(65) Prior Publication Data

US 2012/0285855 A1 Nov. 15, 2012

Related U.S. Application Data

(60) Provisional application No. 61/518,837, filed on May 12, 2011.

(51) Int. Cl.

| | |
|---|---|
| ***B65D 65/00*** | (2006.01) |
| ***B65D 75/00*** | (2006.01) |
| ***B65D 71/18*** | (2006.01) |
| ***B65D 71/20*** | (2006.01) |

(Continued)

(52) U.S. Cl.

CPC ..... *B65D 71/18* (2013.01); *B65D 71/20* (2013.01); *B65D 71/32* (2013.01); *B65D 71/34* (2013.01); *B65D 2571/00185* (2013.01); *B65D 2571/00265* (2013.01); *B65D 2571/00444* (2013.01); *B65D 2571/00561* (2013.01); *B65D 2571/0066* (2013.01); *B65D 2571/00716* (2013.01)

(58) Field of Classification Search

CPC ..... B65D 71/18; B65D 71/20; B65D 71/32; B65D 71/34; B65D 71/14; B65D 2571/00716; B65D 2571/00265

USPC ..... 206/434, 139–203, 427, 146–149; 229/103.2, 198.2; 493/84

See application file for complete search history.

(56) References Cited

U.S. PATENT DOCUMENTS

| | | | |
|---|---|---|---|
| 2,849,111 | A | 8/1958 | Fielding |
| 2,888,135 | A | 5/1959 | Reynolds |

(Continued)

FOREIGN PATENT DOCUMENTS

| | | |
|---|---|---|
| BE | 671762 | 3/1966 |
| CA | 2542350 | 5/2005 |

(Continued)

OTHER PUBLICATIONS

International Search Report and Written Opinion for PCT/US2012/060982 dated Mar. 28, 2013.

(Continued)

*Primary Examiner* — Mickey Yu
*Assistant Examiner* — Chun Cheung
(74) *Attorney, Agent, or Firm* — Womble Carlyle Sandridge & Rice, LLP

(57) ABSTRACT

A carton for carrying a plurality of articles. The carton having a plurality of panels at least partially extending around an interior of the carton, the plurality of panels comprising at least one bottom panel and at least one side panel foldably connected to the bottom panel. The carton further having at least one retention tab foldably connected to the at least one bottom panel. The at least one retention tab is for engaging at least a portion of an article of the plurality of articles, and the at least one retention tab comprises a first portion foldably connected to the bottom panel at a first fold line and a second portion foldably connected to the first portion at a second fold line.

33 Claims, 10 Drawing Sheets

(51) Int. Cl.
*B65D 71/32* (2006.01)
*B65D 71/34* (2006.01)

(56) References Cited

U.S. PATENT DOCUMENTS

| | | | | | |
|---|---|---|---|---|---|
| RE24,667 | E | | 7/1959 | Fielding | |
| 2,922,561 | A | | 1/1960 | Currivan | |
| 2,928,541 | A | | 3/1960 | Fielding | |
| 2,929,497 | A | | 3/1960 | De Million-Czarnecki | |
| 3,128,010 | A | | 4/1964 | Forrer | |
| 3,156,404 | A | * | 11/1964 | Wood | 206/148 |
| 3,178,242 | A | | 4/1965 | Ellis | |
| 3,194,476 | A | | 7/1965 | Weiss | |
| 3,229,892 | A | | 1/1966 | Weiss | |
| 3,237,762 | A | | 3/1966 | Wood | |
| 3,252,649 | A | | 5/1966 | Graser et al. | |
| 3,278,075 | A | | 10/1966 | Weiss | |
| 3,292,843 | A | | 12/1966 | Chidsey, Jr. et al. | |
| 3,300,115 | A | | 1/1967 | Schauer | |
| 3,306,519 | A | | 2/1967 | Wood | |
| 3,339,723 | A | | 9/1967 | Wood | |
| 3,343,660 | A | | 9/1967 | Bailey | |
| 3,355,012 | A | | 11/1967 | Weiss | |
| 3,356,279 | A | | 12/1967 | Root | |
| 3,367,557 | A | | 2/1968 | Farquhar | |
| 3,373,867 | A | | 3/1968 | Wood | |
| 3,375,968 | A | | 4/1968 | Weiss | |
| 3,429,496 | A | | 2/1969 | Hickin | |
| 3,447,672 | A | | 6/1969 | Bailey | |
| 3,462,011 | A | | 8/1969 | Farquhar | |
| 3,517,858 | A | | 6/1970 | Farquhar | |
| 3,517,876 | A | | 6/1970 | Stout | |
| 3,593,849 | A | | 7/1971 | Helms | |
| 3,635,452 | A | | 1/1972 | Helms | |
| 3,655,117 | A | | 4/1972 | Weiss | |
| 3,669,342 | A | | 6/1972 | Funkhouser | |
| 3,669,343 | A | | 6/1972 | Howard | |
| 3,715,029 | A | | 2/1973 | Wood | |
| 3,747,835 | A | | 7/1973 | Graser | |
| 3,767,042 | A | | 10/1973 | Ganz | |
| 3,963,121 | A | | 6/1976 | Kipp | |
| 4,004,500 | A | | 1/1977 | Wood | |
| 4,010,593 | A | | 3/1977 | Graham | |
| 4,032,053 | A | | 6/1977 | Wilson | |
| 4,096,985 | A | | 6/1978 | Wood | |
| 4,101,069 | A | | 7/1978 | Wood | |
| 4,200,220 | A | | 4/1980 | Ganz | |
| 4,202,446 | A | | 5/1980 | Sutherland | |
| 4,215,781 | A | | 8/1980 | Humphries et al. | |
| 4,328,893 | A | | 5/1982 | Oliff et al. | |
| 4,355,717 | A | | 10/1982 | Oliff | |
| 4,382,505 | A | | 5/1983 | Sutherland et al. | |
| 4,394,903 | A | | 7/1983 | Bakx | |
| 4,421,232 | A | | 12/1983 | Konaka | |
| 4,424,901 | A | | 1/1984 | Lanier | |
| 4,440,340 | A | | 4/1984 | Bakx | |
| 4,533,047 | A | | 8/1985 | Calvert | |
| 4,545,485 | A | | 10/1985 | Oliff | |
| 4,566,593 | A | | 1/1986 | Muller | |
| 4,611,754 | A | | 9/1986 | Sutherland | |
| 4,708,284 | A | | 11/1987 | Sutherland et al. | |
| 4,747,487 | A | | 5/1988 | Wood | |
| 4,784,266 | A | | 11/1988 | Chaussadas | |
| 4,804,089 | A | | 2/1989 | Wilson | |
| 4,815,599 | A | | 3/1989 | Schuster | |
| 4,836,375 | A | | 6/1989 | Schuster | |
| 4,844,328 | A | | 7/1989 | Cooper | |
| 4,860,943 | A | | 8/1989 | Cooper | |
| 4,875,585 | A | | 10/1989 | Kadleck et al. | |
| 4,878,612 | A | | 11/1989 | Schuster | |
| 4,901,849 | A | | 2/1990 | Wilson | |
| 4,919,266 | A | | 4/1990 | McIntosh, Jr. et al. | |
| 4,966,324 | A | | 10/1990 | Steel | |
| 4,972,991 | A | | 11/1990 | Schuster | |
| 5,000,313 | A | | 3/1991 | Oliff | |
| 5,042,660 | A | | 8/1991 | Carver | |
| 5,060,792 | A | | 10/1991 | Oliff | |
| 5,060,804 | A | | 10/1991 | Beales et al. | |
| 5,094,347 | A | | 3/1992 | Schuster | |
| 5,131,588 | A | | 7/1992 | Oliff | |
| 5,180,100 | A | | 1/1993 | Shimizu | |
| 5,195,676 | A | | 3/1993 | LeBras | |
| 5,197,598 | A | | 3/1993 | Stout et al. | |
| 5,246,112 | A | | 9/1993 | Stout et al. | |
| 5,246,122 | A | | 9/1993 | Schick et al. | |
| 5,297,673 | A | | 3/1994 | Sutherland | |
| 5,310,050 | A | | 5/1994 | Sutherland | |
| 5,311,984 | A | | 5/1994 | Harris | |
| 5,328,080 | A | | 7/1994 | Holley, Jr. | |
| 5,351,878 | A | | 10/1994 | Cooper | |
| 5,381,891 | A | | 1/1995 | Harriw | |
| 5,395,043 | A | | 3/1995 | Bacques et al. | |
| 5,398,870 | A | | 3/1995 | Bienaime | |
| 5,421,458 | A | | 6/1995 | Campbell | |
| 5,437,363 | A | | 8/1995 | Gungner | |
| 5,443,203 | A | | 8/1995 | Sutherland | |
| 5,472,090 | A | | 12/1995 | Sutherland | |
| 5,472,138 | A | | 12/1995 | Ingram | |
| 5,485,915 | A | | 1/1996 | Harris | |
| 5,505,372 | A | | 4/1996 | Edson et al. | |
| 5,520,283 | A | | 5/1996 | Sutherland | |
| 5,524,756 | A | | 6/1996 | Sutherland | |
| 5,542,536 | A | | 8/1996 | Sutherland | |
| 5,551,556 | A | | 9/1996 | Sutherland | |
| 5,558,212 | A | | 9/1996 | Sutherland | |
| 5,558,213 | A | | 9/1996 | Sutherland | |
| 5,588,586 | A | | 12/1996 | Negelen | |
| 5,597,071 | A | | 1/1997 | Sutherland | |
| 5,605,228 | A | | 2/1997 | Baxter | |
| 5,609,251 | A | | 3/1997 | Harris | |
| 5,638,956 | A | * | 6/1997 | Sutherland | 206/434 |
| 5,647,483 | A | | 7/1997 | Harris | |
| 5,653,341 | A | | 8/1997 | Miret | |
| 5,664,401 | A | | 9/1997 | Portrait et al. | |
| 5,671,845 | A | | 9/1997 | Harris | |
| 5,682,995 | A | | 11/1997 | Sutherland | |
| 5,692,614 | A | | 12/1997 | Harris | |
| 5,704,542 | A | | 1/1998 | Harrelson | |
| 5,765,685 | A | | 6/1998 | Roosa | |
| 5,778,630 | A | | 7/1998 | Portrait et al. | |
| 5,782,343 | A | | 7/1998 | Harrelson | |
| 5,853,088 | A | | 12/1998 | Saulas et al. | |
| 5,855,318 | A | | 1/1999 | Baxter | |
| 5,868,308 | A | | 2/1999 | Briand | |
| 5,924,628 | A | | 7/1999 | Oliff | |
| 5,931,300 | A | | 8/1999 | Sutherland | |
| 5,937,620 | A | | 8/1999 | Chalendar | |
| 5,941,389 | A | | 8/1999 | Gomes | |
| 5,941,453 | A | | 8/1999 | Oliff | |
| 5,943,847 | A | | 8/1999 | Chalendar | |
| 5,947,367 | A | | 9/1999 | Miller et al. | |
| 5,957,289 | A | | 9/1999 | Negelen | |
| 5,975,286 | A | | 11/1999 | Oliff | |
| 6,019,220 | A | | 2/2000 | Sutherland | |
| 6,021,898 | A | | 2/2000 | Sutherland | |
| 6,021,899 | A | | 2/2000 | Sutherland | |
| 6,085,969 | A | | 7/2000 | Burgoyne | |
| 6,109,438 | A | | 8/2000 | Sutherland | |
| 6,155,480 | A | | 12/2000 | Botsford et al. | |
| 6,158,586 | A | | 12/2000 | Muller | |
| 6,173,889 | B1 | | 1/2001 | Sutherland | |
| 6,227,367 | B1 | | 5/2001 | Harrelson et al. | |
| 6,283,293 | B1 | | 9/2001 | Lingamfelter | |
| 6,289,651 | B1 | | 9/2001 | Le Bras | |
| 6,315,123 | B1 | | 11/2001 | Ikeda | |
| 6,378,697 | B1 | | 4/2002 | Sutherland et al. | |
| 6,378,765 | B1 | | 4/2002 | Sutherland | |
| 6,415,917 | B1 | | 7/2002 | Marco | |
| 6,527,108 | B1 | | 3/2003 | Blin et al. | |
| 6,550,616 | B2 | | 4/2003 | Le Bras | |
| 6,736,260 | B2 | | 5/2004 | Gomes et al. | |
| 6,789,673 | B2 | | 9/2004 | Lingamfelter | |
| 6,811,525 | B2 | | 11/2004 | Culpepper | |
| 6,866,185 | B2 | | 3/2005 | Harrelson | |

(56) References Cited

U.S. PATENT DOCUMENTS

| | | | | |
|---|---|---|---|---|
| 6,877,600 | B2 | 4/2005 | Sutherland | |
| 6,948,651 | B2 | 9/2005 | Ikeda | |
| 6,981,631 | B2 | 1/2006 | Fogle et al. | |
| 6,988,617 | B2 * | 1/2006 | Gomes et al. | 206/434 |
| 7,007,800 | B2 | 3/2006 | Le Bras | |
| 7,025,197 | B2 | 4/2006 | Sutherland | |
| 7,159,759 | B2 | 1/2007 | Sutherland | |
| 7,175,020 | B2 | 2/2007 | Sutherland et al. | |
| 7,222,777 | B2 | 5/2007 | Garnier | |
| 7,380,701 | B2 | 6/2008 | Fogle et al. | |
| 7,427,010 | B2 | 9/2008 | Sutherland | |
| 7,448,492 | B2 | 11/2008 | Sutherland | |
| 7,644,817 | B2 | 1/2010 | Sutherland | |
| 7,677,387 | B2 | 3/2010 | Brand et al. | |
| 7,762,395 | B2 | 7/2010 | Sutherland et al. | |
| 7,762,397 | B2 | 7/2010 | Coltri-Johnson et al. | |
| 7,832,183 | B2 | 11/2010 | Jacob et al. | |
| 7,900,815 | B2 | 3/2011 | Shmagin | |
| 7,913,844 | B2 | 3/2011 | Spivey, Sr. | |
| 8,083,061 | B2 | 12/2011 | Fogel et al. | |
| 8,317,082 | B2 | 11/2012 | May et al. | |
| 2003/0000182 | A1 | 1/2003 | Portrait et al. | |
| 2003/0132130 | A1 | 7/2003 | Le Bras | |
| 2004/0000582 | A1 | 1/2004 | Sutherland | |
| 2004/0011674 | A1 | 1/2004 | Theelen | |
| 2004/0069659 | A1 | 4/2004 | Sutherland | |
| 2004/0089671 | A1 | 5/2004 | Miller | |
| 2004/0188277 | A1 | 9/2004 | Auclair | |
| 2004/0188301 | A1 | 9/2004 | Gomes | |
| 2004/0243277 | A1 | 12/2004 | Bonnain et al. | |
| 2004/0254666 | A1 | 12/2004 | Bonnain et al. | |
| 2005/0001020 | A1 | 1/2005 | Garnier | |
| 2005/0103652 | A1 | 5/2005 | Wilkins | |
| 2005/0167290 | A1 | 8/2005 | Sutherland | |
| 2005/0178791 | A1 | 8/2005 | Miller | |
| 2005/0194430 | A1 | 9/2005 | Auclair et al. | |
| 2006/0157545 | A1 | 7/2006 | Auclair | |
| 2006/0191811 | A1 | 8/2006 | Fogle et al. | |
| 2006/0255108 | A1 | 11/2006 | Shmagin | |
| 2007/0017829 | A1 | 1/2007 | Sutherland | |
| 2007/0241017 | A1 | 10/2007 | Sutherland et al. | |
| 2010/0072267 | A1 | 3/2010 | May | |
| 2012/0267426 | A1 | 10/2012 | Hendricks et al. | |
| 2012/0285855 | A1 | 11/2012 | Spivey, Sr. | |

FOREIGN PATENT DOCUMENTS

| | | | |
|---|---|---|---|
| DE | 22 23 787 | A1 | 11/1973 |
| DE | 9104905.9 | | 6/1991 |
| DE | 9203858.1 | | 5/1992 |
| EP | 0 242 992 | A2 | 11/1969 |
| EP | 0 159 172 | A2 | 10/1985 |
| EP | 0 233 078 | A2 | 8/1987 |
| EP | 0459658 | | 12/1991 |
| EP | 0509749 | | 10/1992 |
| EP | 0520411 | | 12/1992 |
| EP | 0 388 238 | B1 | 6/1993 |
| FR | 2698074 | | 5/1994 |
| GB | 1 172 430 | | 11/1969 |
| JP | 4118199 | | 10/1965 |
| JP | 61-2545 | | 1/1986 |
| JP | 62-231736 | | 10/1987 |
| JP | 5112373 | | 5/1993 |
| JP | 2003-252323 | | 9/2003 |
| WO | WO9727124 | | 6/1977 |
| WO | WO 98/09871 | | 3/1998 |
| WO | WO 99/11538 | A1 | 3/1999 |
| WO | WO 00/78634 | | 12/2000 |
| WO | WO02102208 | | 12/2002 |
| WO | WO03008292 | | 1/2003 |
| WO | WO2004087507 | | 10/2004 |
| WO | WO 2005/047134 | A1 | 5/2005 |
| WO | WO2005092735 | | 10/2005 |
| WO | WO2005042370 | | 12/2005 |
| WO | WO2007126977 | | 11/2007 |
| WO | WO2009015320 | | 1/2009 |

OTHER PUBLICATIONS

International Search Report and Written Opinion for PCT/US2012/034197 dated Oct. 16, 2012.

PCT/US2012/037465—ISR and WO mailed Nov. 16, 2012 for related application.

Supplementary European Search Report for EP 12 78 2846 dated Oct. 17, 2014.

Supplementary European Search Report for EP 12 77 4282 dated Oct. 30, 2014.

* cited by examiner

CARRIER WITH RETENTION FEATURES

CROSS-REFERENCE TO RELATED APPLICATIONS

This application claims the benefit of U.S. Provisional Application No. 61/518,837, which was filed on May 12, 2011.

INCORPORATION BY REFERENCE

U.S. Provisional Application No. 61/518,837, which was filed on May 12, 2011, is hereby incorporated by reference for all purposes as if presented herein in its entirety.

BACKGROUND OF THE DISCLOSURE

The present disclosure generally relates to carriers for holding and dispensing beverage containers or other types of articles.

SUMMARY OF THE DISCLOSURE

In general, one aspect of the disclosure is directed a carton for carrying a plurality of articles. The carton comprises a plurality of panels at least partially extending around an interior of the carton, the plurality of panels comprising at least one bottom panel and at least one side panel foldably connected to the bottom panel. The carton further comprises at least one retention tab foldably connected to the at least one bottom panel. The at least one retention tab is for engaging at least a portion of an article of the plurality of articles, and the at least one retention tab comprises a first portion foldably connected to the bottom panel at a first fold line and a second portion foldably connected to the first portion at a second fold line.

In another aspect, the disclosure is generally directed to a blank for forming a carton for holding a plurality of articles. The blank comprises a plurality of panels comprising at least one bottom panel and at least one side panel foldably connected to the bottom panel and at least one retention tab foldably connected to the at least one bottom panel. The at least one retention tab is for engaging at least a portion of an article, and the at least one retention tab comprises a first portion foldably connected to the bottom panel at a first fold line and a second portion foldably connected to the first portion at a second fold line.

In another aspect, the disclosure is directed to a method of forming a carton for carrying a plurality of articles from a blank. The method includes obtaining a blank comprising a plurality of panels comprising at least one bottom panel, at least one side panel foldably connected to the bottom panel, and at least one retention tab foldably connected to the at least one bottom panel. The at least one retention tab comprises a first portion foldably connected to the bottom panel at a first fold line and a second portion foldably connected to the first portion at a second fold line. The method further includes forming at least a portion of an interior of the carton by folding the at least one side panel relative to the at least one bottom panel and positioning the retention tab for engaging at least a portion of an article of the plurality of articles.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons or carriers that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., aluminum beverage cans) as disposed within the carrier embodiments. In this specification, the terms "lower," "bottom," "upper" and "top" indicate orientations determined in relation to fully erected and upright cartons.

Furthermore, for the purpose of illustration and not for the purpose of limiting the scope of the disclosure, the following detailed description describes several varieties of features including fold lines, tear lines, crease lines, scores, cut lines, cut-crease lines, and other similar features. Unless otherwise noted or clearly indicated in the context of the described embodiments, these features are readily interchangeable according to any desired implementation of the described embodiments.

Figure 1:
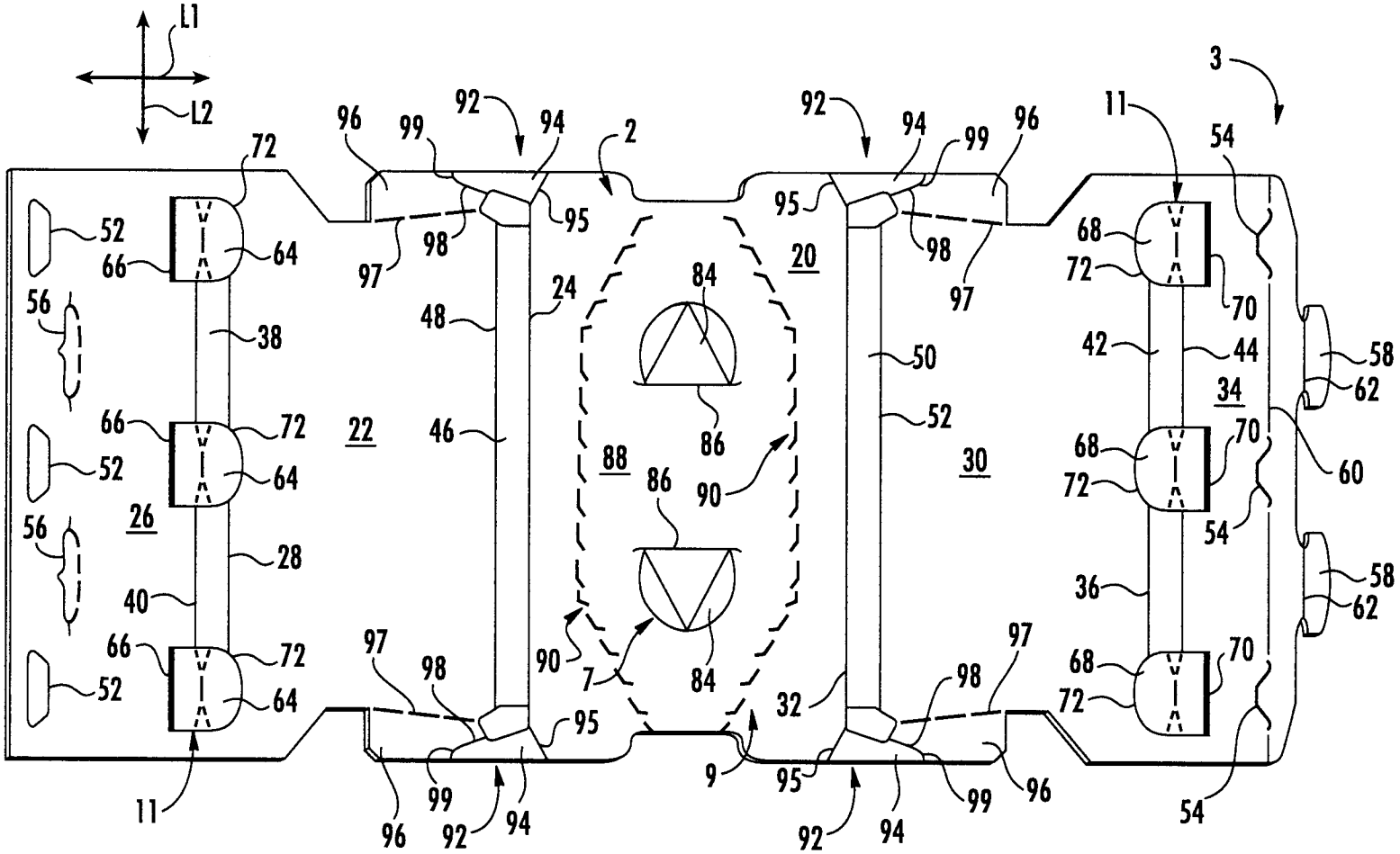
FIG. 1 is a plan view of an exterior surface of a blank used to form a carrier according to a first embodiment.
Figure 5:
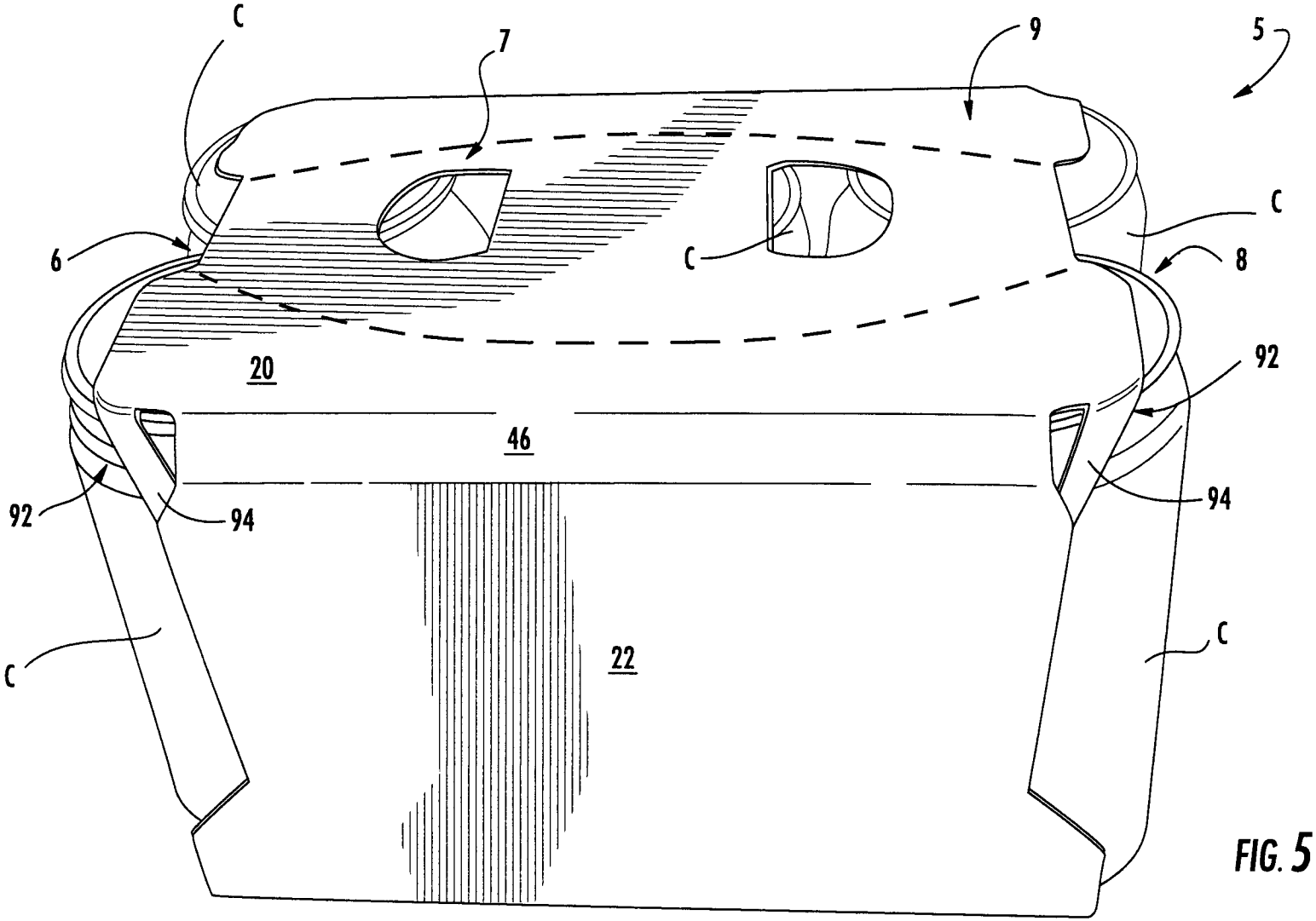
FIG. 5 is a perspective view of the assembled carrier and containers.

Turning now to the drawings, FIG. 1 is a plan view of an exterior surface 2 of a blank 3, used to form a carrier 5 (FIG. 5) according to a first embodiment of the disclosure. The carrier 5 can be used to house a plurality of articles such as containers C (FIG. 5). In the illustrated embodiment, the containers C are beverage cans and the carrier 5 is sized to house six containers in a single layer in a 2×3 arrangement, but it is understood that the carrier 5 may be sized and shaped to hold containers C of a different or same quantity in more than one layer and/or in different row/column arrangements (e.g., 1×6, 2×6, 2×4, 2×2, 2×6×2, 2×4×2, 2×9, etc.). In the illustrated embodiment, the carrier 5 can include bottom retention features 11 for engaging the bottom portions B of the containers C. In addition, the carrier 5 can include a handle, generally indicated at 7, for grasping and carrying the carrier 5. The carrier 5 can also include a dispenser 9 for accessing the container C in the carrier.

In the illustrated embodiment, the carrier 5 is a carrier having generally open ends 6, 8 (FIG. 5) that wraps around the containers C (e.g., the carrier 5 may be referred to as a wrap-around carton). The carrier 5 could be otherwise shaped and arranged such the ends 6, 8 are at least partially closed such as by end flaps (not shown) or other closing mechanisms.

The blank 3 has a longitudinal axis L1 and a lateral axis L2. In the illustrated embodiment, the blank 3 comprises a top panel 20 foldably connected to a first side panel 22 at a first lateral fold line 24, a first bottom panel 26 foldably connected to the first side panel 22 at a second lateral fold line 28, a second side panel 30 foldably connected to the top panel 20 at a third lateral fold line 32, and a second bottom panel 34 foldably connected to the second side panel 30 at a fourth lateral fold line 36. In the illustrated embodiment, the first bottom panel 26 includes a first bottom bevel panel 38 defined by lateral fold lines 28 and 40. The second bottom panel 34 includes a second bottom bevel panel 42 defined by lateral fold lines 36 and 44. Additionally, the first side panel 22 can include a first top bevel panel 46 defined by lateral fold lines 24 and 48, and the second side panel 30 can include a second top bevel panel 50 defined by lateral fold lines 32 and 52.

The first bottom panel 26, which is the inner bottom panel flap in the assembled carrier 5, includes cutouts forming primary female locking edges 52 that are shaped and positioned to engage primary male locking tab projections 54 on the second bottom panel 34. The first bottom panel 26 also includes slits 56 shaped and positioned to receive outer secondary locking tab projections 58 of the second bottom panel 34. The second bottom panel 34, which is the outer bottom panel in the completed carrier 5, includes a lateral fold line 60, which is interrupted by the slits that define the primary male locking tab projections 54. In addition, each of the secondary locking tab projections 58 can include a lateral fold line 62. Although the locking elements of the blank 3 are illustrated to demonstrate a particular bottom panel locking arrangement suitable for use with the carrier 5 (FIGS. 4 and 6), it is understood that any alternative form of bottom panel locking structure may be employed without departing from the disclosure. Further, the bottom panels 26, 34 could be connected without a locking structure (e.g., by glue or other adhesives), or the blank 3 could have only a single bottom panel without departing from the disclosure.

Figure 2A:
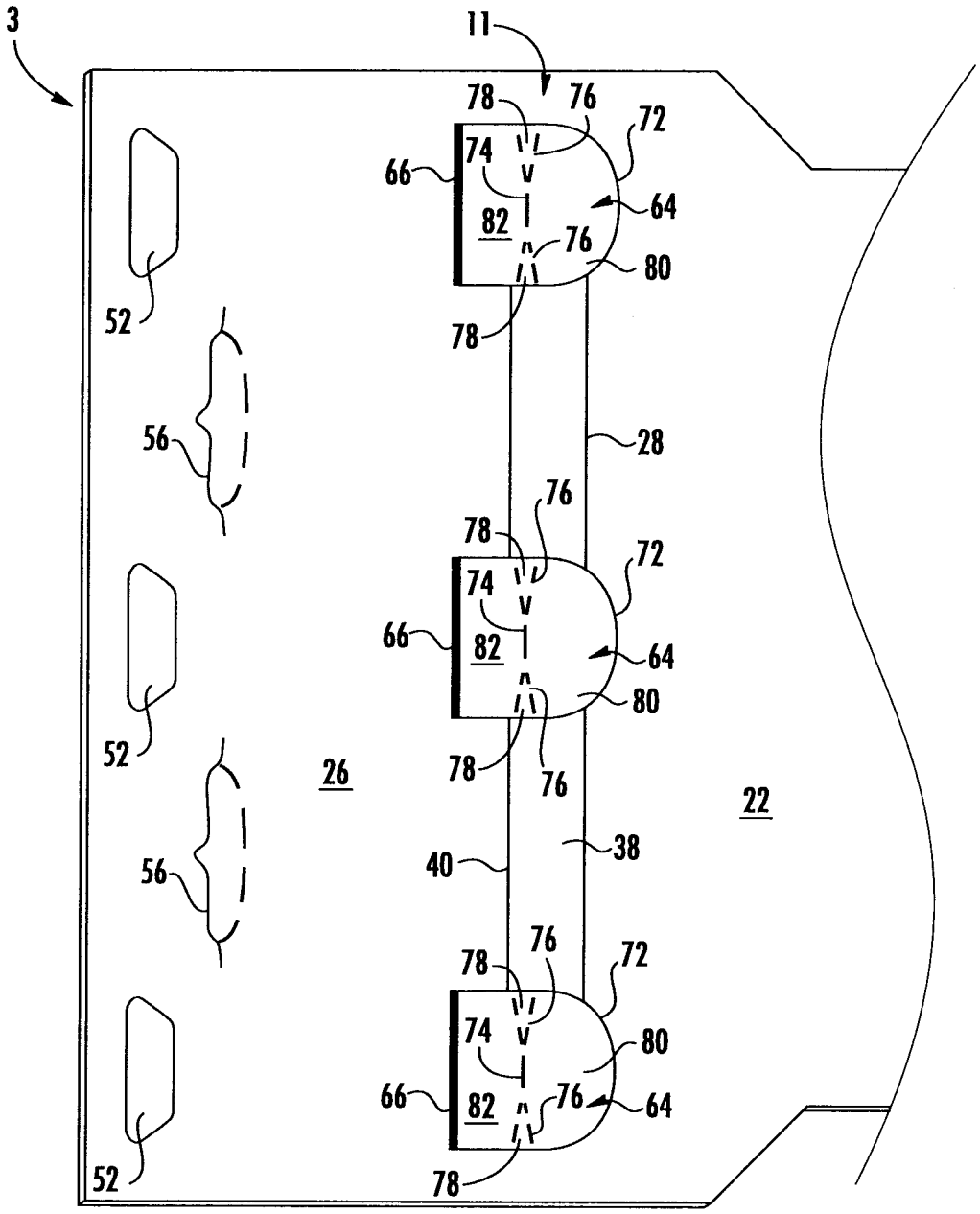
FIGS. 2A and 2B are plan views of a retention feature in the blank of FIG. 1.
Figure 2B:
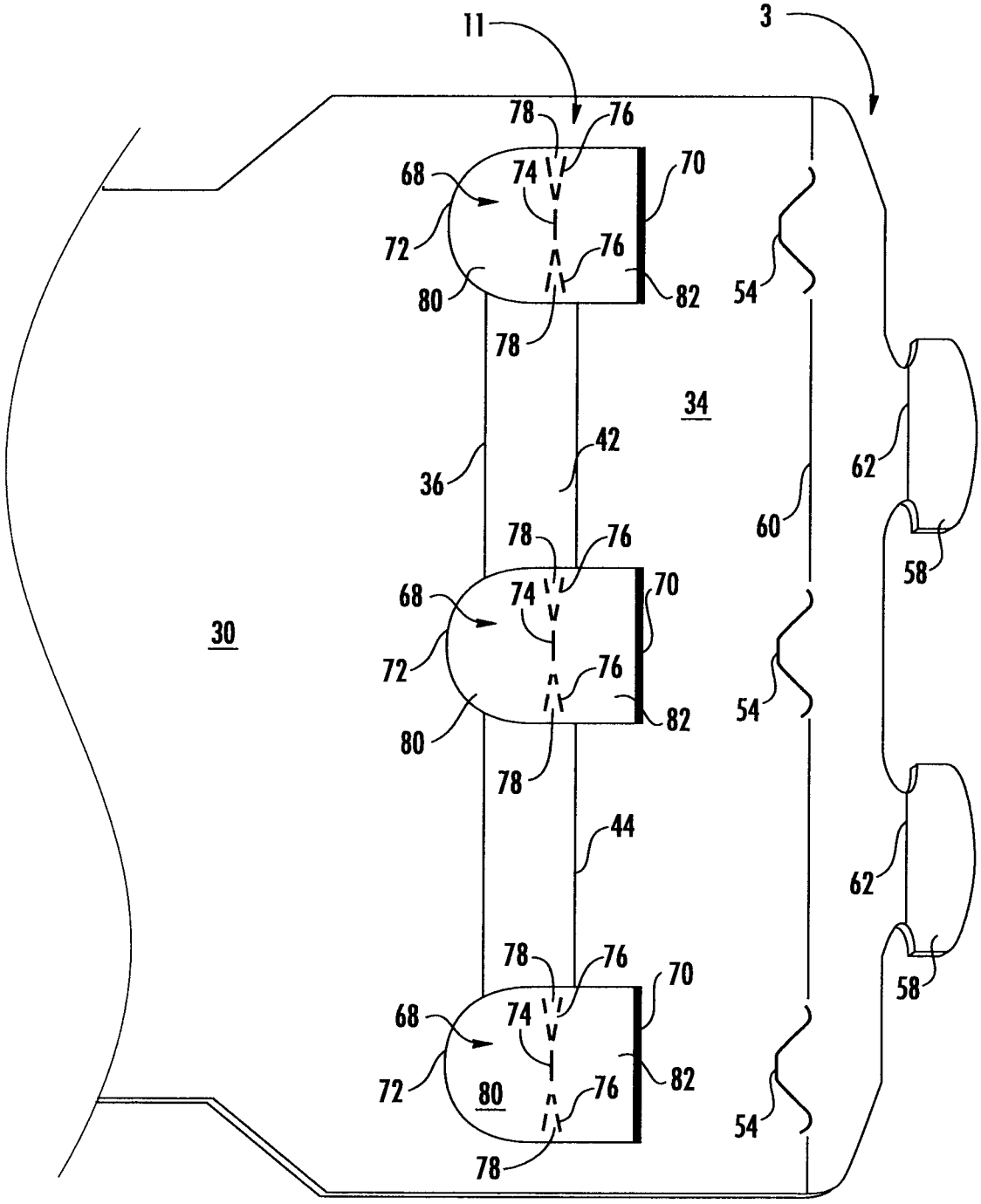

As shown in FIGS. 1, 2A, and 2B, the bottom retention features 11 can include first retention tabs 64 each foldably connected to the first bottom panel 26 along a respective lateral fold line 66. Furthermore, the bottom retention features 11 can include second retention tabs 68 each foldably connected to the second bottom panel 34 along a respective lateral fold line 70. Each of the first and second retention tabs 64, 68 can be further defined by respective cut lines 72, which can be generally semicircular, arcuate, U-shaped, or the like. As shown in FIGS. 2A and 2B, each of the first and second retention tabs 64, 68 includes a lateral fold line 74 extending between two fold lines 76. According to some exemplary embodiments, the fold lines 76 are bifurcated fold lines extending from the lateral fold line 74. According to other exemplary embodiments, the fold lines 76 are arcuate fold lines with a medial portion proximate the lateral fold line 74. Accordingly, the particular shape of fold lines 76 illustrated may be modified to include any similar shapes without departing from the disclosure.

Figure 6:
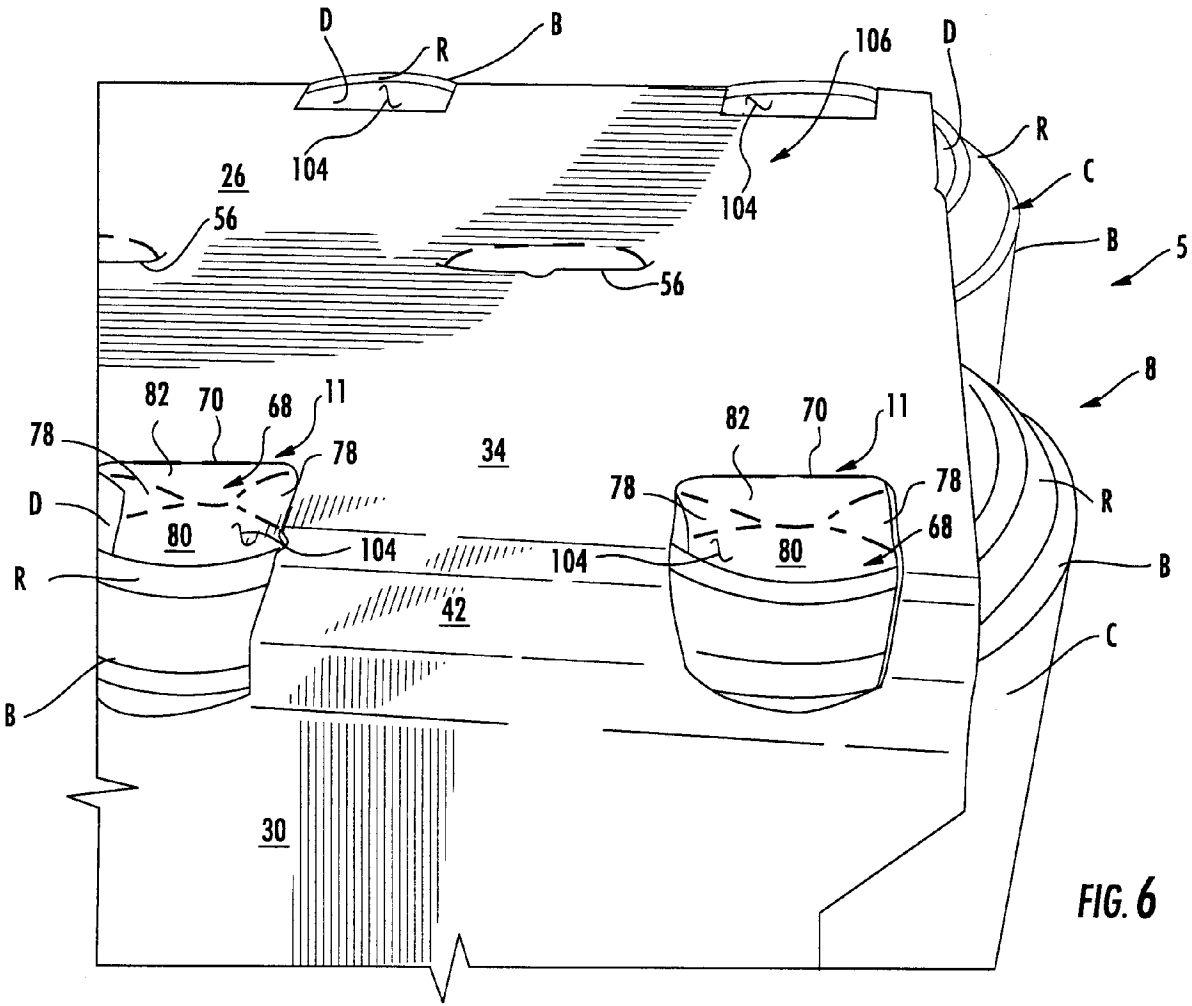
FIG. 6 is a perspective view showing an interaction of the retention feature of the assembled carrier and a container.

In one embodiment, an intermediate portion 78 is defined by each of the fold lines 76 and an adjacent portion of the respective cut line 72. Each intermediate portion 78 may be generally triangular shaped, parabolic, or semicircular depending on any desired shape of the fold line 76. Each of the first and second retention tabs 64, 68 can also comprise a distal portion 80 foldably connected to a proximal portion 82 along the lateral fold line 74 and fold lines 76. In the illustrated embodiment, each of the first and second retention tabs 64, 68 is positioned to engage at least a portion of a rim R of a dome feature D at the bottom B of a respective container C (FIG. 6). Alternatively, the first and second retention tabs 64, 68 can be omitted or otherwise shaped, arranged, positioned, and/or configured without departing from the disclosure.

As shown in FIG. 1, the handle 7 includes two finger flaps 84, each respectively formed by slits and foldably attached to the top panel 20 at a respective longitudinal fold line 86. The handle 7 could include other features for carrying the carrier 5, the finger flaps 84 could be otherwise positioned, shaped, and/or arranged, or the handle 7 could be omitted from the carrier without departing from the disclosure.

In the illustrated embodiment, the dispenser 9 includes a dispenser panel 88 formed by two tear lines 90 extending in the top panel 20. The dispenser 9 could include other features for opening the carrier 5, the dispenser panel 88 could be otherwise positioned, shaped, and/or arranged, or the dispenser 9 could be omitted from the carrier without departing from the disclosure.

In the illustrated embodiment, the top panel 20 is generally rectangular having top retainer features in the form of a top retainer 92 located at each corner. The top retainers 92 each include a side retention panel 94 foldably connected to the top panel 20 at a first oblique fold line 95 and a tuck-in panel 96 foldably connected to one of the side panels 22, 30 at second oblique fold line 97. Each tuck-in panel 96 is foldably connected to a respective side retention panel 94 at third oblique fold 98. As shown in FIG. 1, each tuck-in panel 96 and side retention panel 94 is separated by a hook-shaped cut 99 extending from the third oblique fold line 98 to a free edge of the blank 3. Alternatively, the top retainers 92 could be omitted or otherwise shaped, arranged, positioned, and/or configured without departing from the disclosure.

Figure 3:
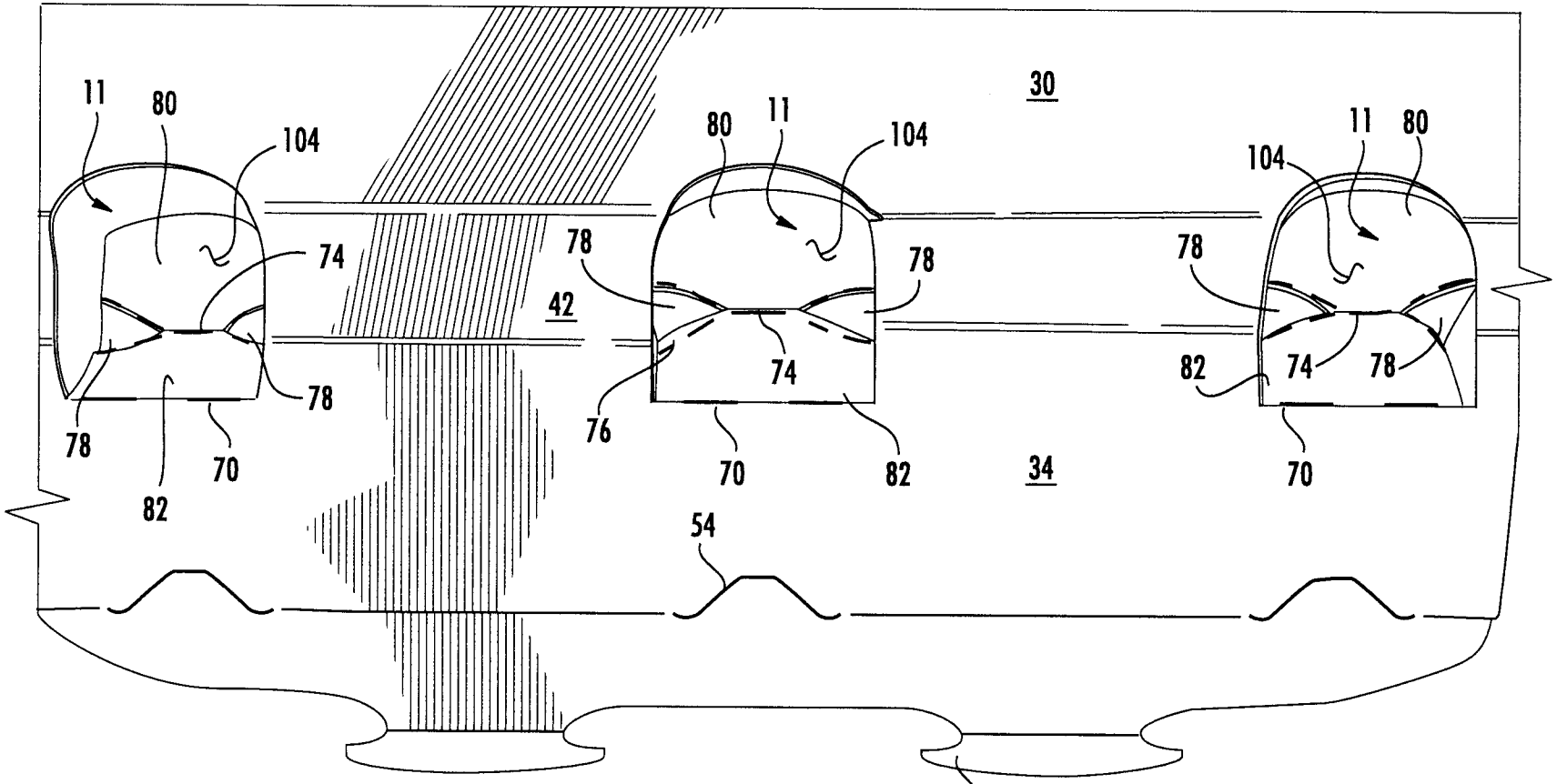
FIG. 3 is a perspective view of the retention feature of FIGS. 2A-2B of a carrier assembled from the blank of FIG. 1.
Figure 4:
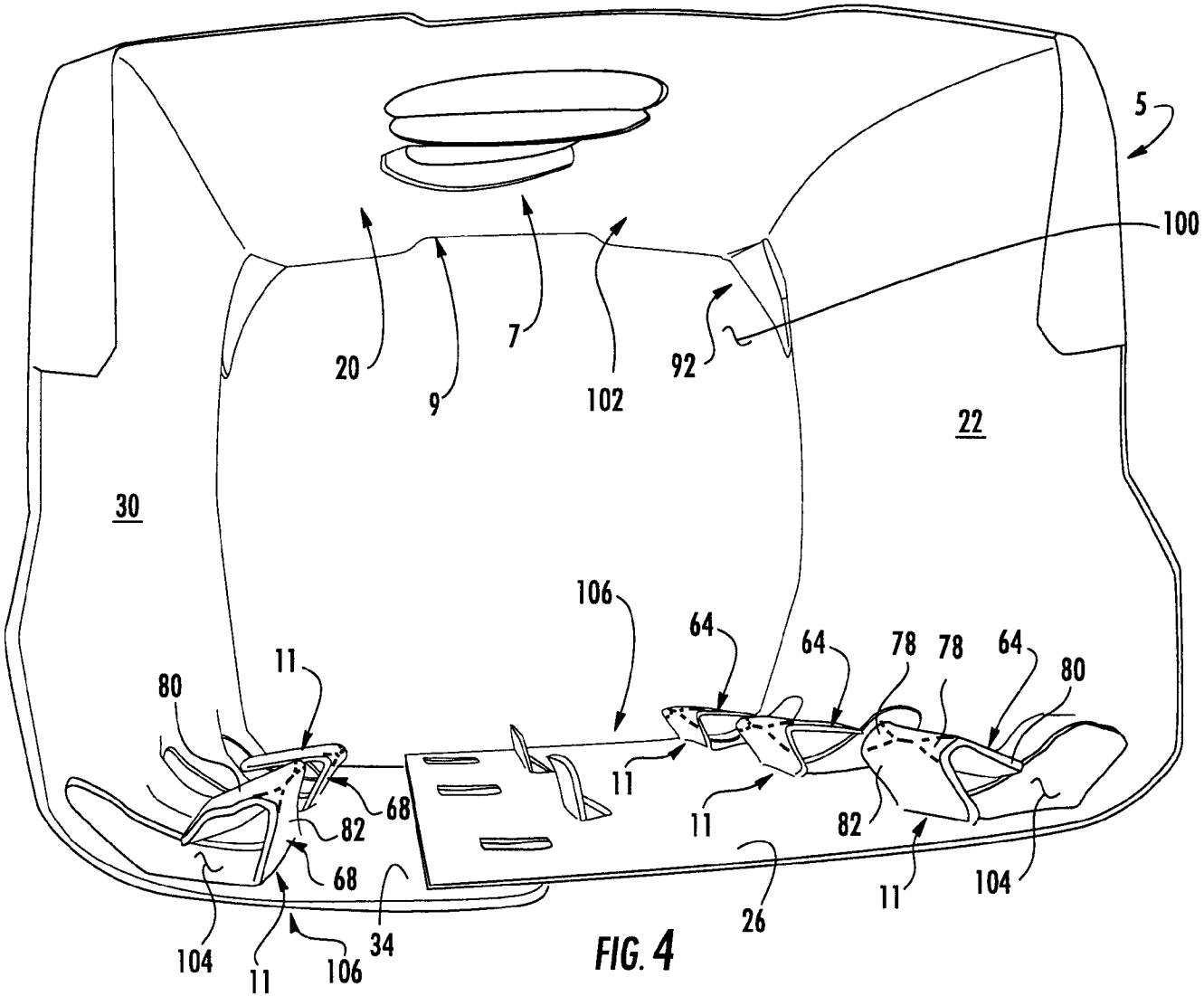
FIG. 4 is a perspective view of an interior of the carrier assembled from the blank of FIG. 1.

As shown in FIGS. 4-6, the carrier 5 can be erected by wrapping the blank 3 around the containers C and interlocking the first and second bottom panels 26, 34 with the bottom retention features 11 actuated to engage the dome features D of the containers C. FIG. 4 illustrates the erected carrier 5 with the containers C omitted to more clearly show the actuated bottom retention features 11. The first and second retention tabs 64, 68 can be actuated by pushing each of the first and second retention tabs 64, 68 from the exterior surface 2 of the blank 3 to fold the first and second retention tabs 64, 68 inwardly along the respective fold lines 66, 70 (FIG. 3). As shown in FIGS. 3-6, the actuated retention tabs 64, 68 form openings 104 for receiving portions of the bottoms B of the containers C. Each of the first and second retention tabs 64, 68 can be further folded along the lateral fold lines 74 and fold lines 76 so that the proximal portion 82 extends generally towards the interior 100 of the carrier 5 from the respective fold line 66, 70, and the distal portion 80 extends generally away from the interior 100 (FIG. 4). As further shown, the intermediate portions 78 are arranged to provide a biasing force between the proximal portions 82 and distal portions 80 such that the distal portions 80 readily engage a respective container C (FIG. 6).

In the illustrated embodiment, the containers C are placed top side down on the interior side 102 of the top panel 20 of the blank 3. The side panels 22, 30 are then folded upwardly toward the containers C along the lateral fold lines 24, 32, 48, 52. As the side panels 22, 30 are folded upwardly, the tuck-in panels 96 are respectively tucked inwardly about the fold lines 97. Accordingly, the side retention panels 94 are drawn inwardly to the position shown in FIGS. 4-5. The side retention panels 94 partially wrap around portions of the containers C at the ends 6, 8 of the carrier 5 (FIG. 5) to respectively form the top retainers 92 at the four top corners of the carrier 5. The tuck-in panels 96 and side retention panels 94 are held in place by virtue of the tuck-in panels 96 being respectively sandwiched (e.g., held, pinched, etc.) between the containers C and the interior surface 102 of the side panels 22, 30. As such, each top retainer 92 is configured to engage a portion of an outer circumference of a respective container C.

As illustrated in FIG. 4, the first and second bottom panels 26, 34 are folded along the respective fold lines 28, 40 and 36, 44, and the second bottom panel 34 is secured to the first bottom panel 26 by first respectively engaging primary male locking tabs 54 with the primary female locking edges 52. The secondary male locking flaps 58 are respectively inserted through, and cooperatively interact with, the slits 56 to further secure the second bottom panel 34 to the first bottom panel 26. The interlocked bottom panels 26, 34 cooperate to form a bottom panel 106 of the carrier 5. As the first and second bottom panels 26, 34 are folded over the bottoms B of the containers C, the actuated retention tabs 64, 68 are inserted into respective dome features D (FIG. 6) and portions of the bottoms B are received in the openings 104.

In the illustrated embodiment, the folded retention tabs 64, 68 can resist withdrawal of the containers C by providing multiple contact points along an edge of the respective distal portion 80, proximal portion 82, and intermediate portion 78, which contact points can engage the rim R of the dome feature D of the respective container C. For example, as shown in FIG. 6, if a container C is forced outwardly toward the end 8 of the carrier 5, the respective first retention tab 68 is in contact the interior of the rim R in the interior 100 of the carrier 5 and resists the outward force. The top retainers 92 resist removal of the containers C at the top corners of the carrier 5 at the ends 6, 8 (FIG. 5), and the retention tabs 64, 68 cooperate with the top retainers 92 to help resist pivoting of the containers C at the ends 6, 8. Accordingly, the retention tabs 64, 68 and the top retainers 92 help prevent undesired ejection of the containers C from the carrier 5. A user can access the carrier 5 such as by opening the dispenser 9 or tearing the carrier 5.

Figure 7:
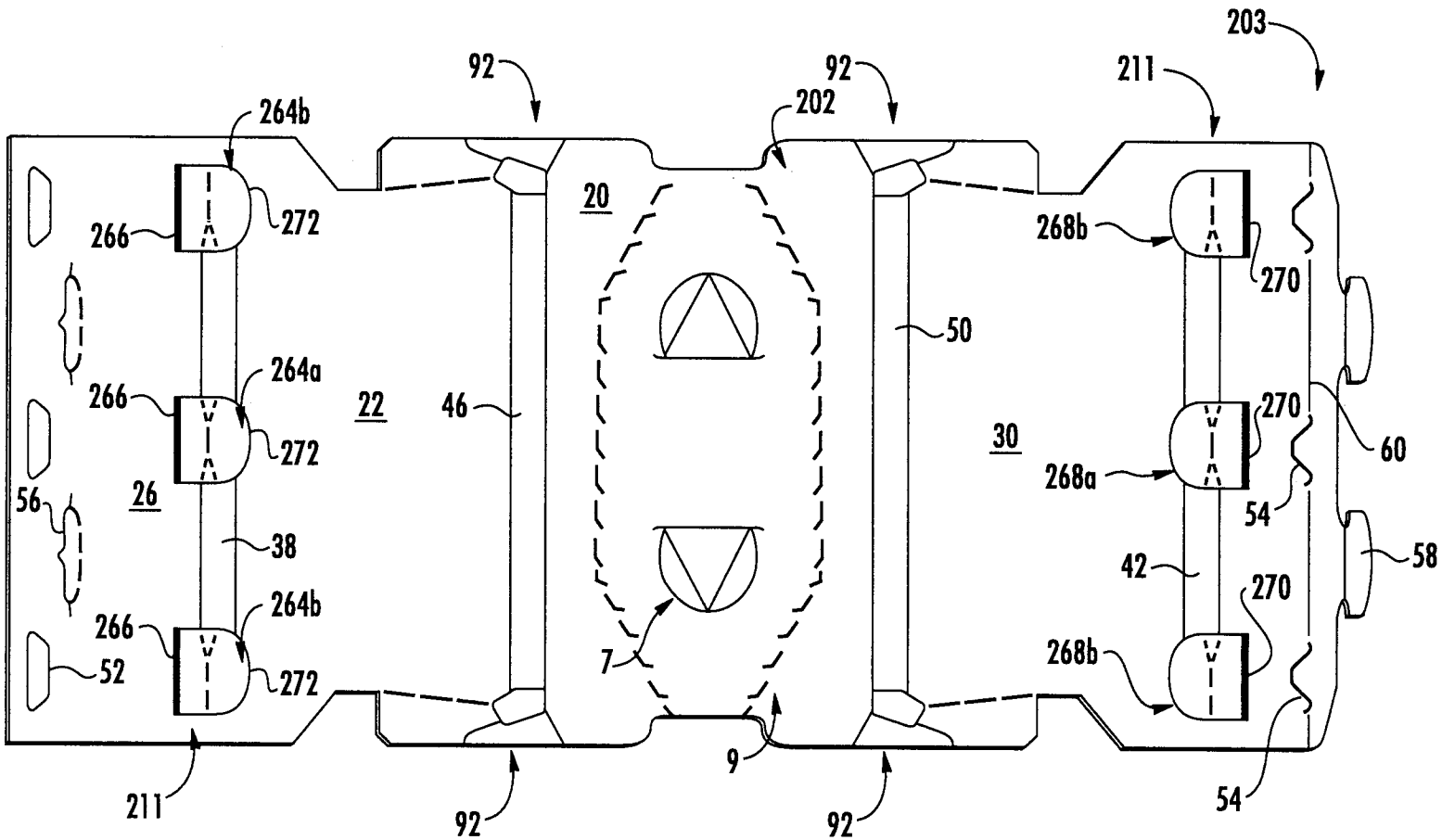
FIG. 7 is a plan view of an exterior surface of a blank used to form a carrier according to a second embodiment.

FIG. 7 is a plan view of an exterior surface 202 of a blank 203 for forming a carrier (not shown) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 7, the blank 203 includes alternative bottom retention features 211 including center retention tabs 264*a*, 268*a* and outer retention tabs 264*b*, 268*b* foldably connected to the bottom panels 26, 34 along respective lateral fold lines 266, 270. The center retention tabs 264*a*, 268*a* are similar to the retention tabs 64, 68 of the first embodiment, wherein the lateral fold line 274 extends between two fold lines 276, which may be arcuate, curved, and/or bifurcated according to any desired implementation. Each of the outer retention tabs 264*b*, 268*b* includes a lateral fold line 274 extending from an outward-facing free edge of the retention tab to a fold line 276 that extends to an interior-facing free edge of the retention tab. Each of the retention tabs 264*a*, 264*b*, 268*a*, 268*b* can be further defined by respective cut lines 272, which can be generally semicircular, arcuate, U-shaped, or the like.

Figure 8A:
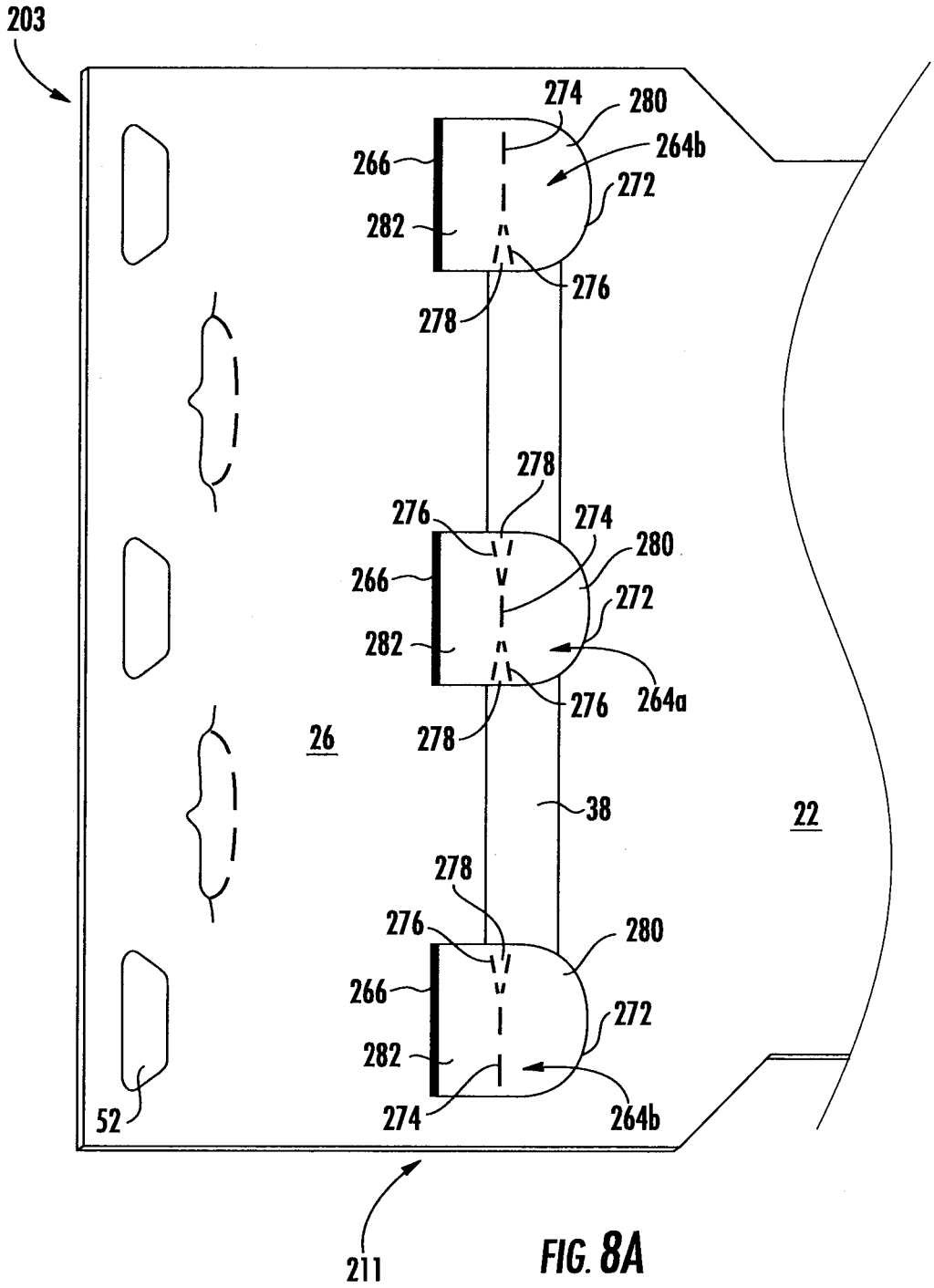
FIGS. 8A and 8B are plan views of a retention feature in the blank of FIG. 7.
Figure 8B:
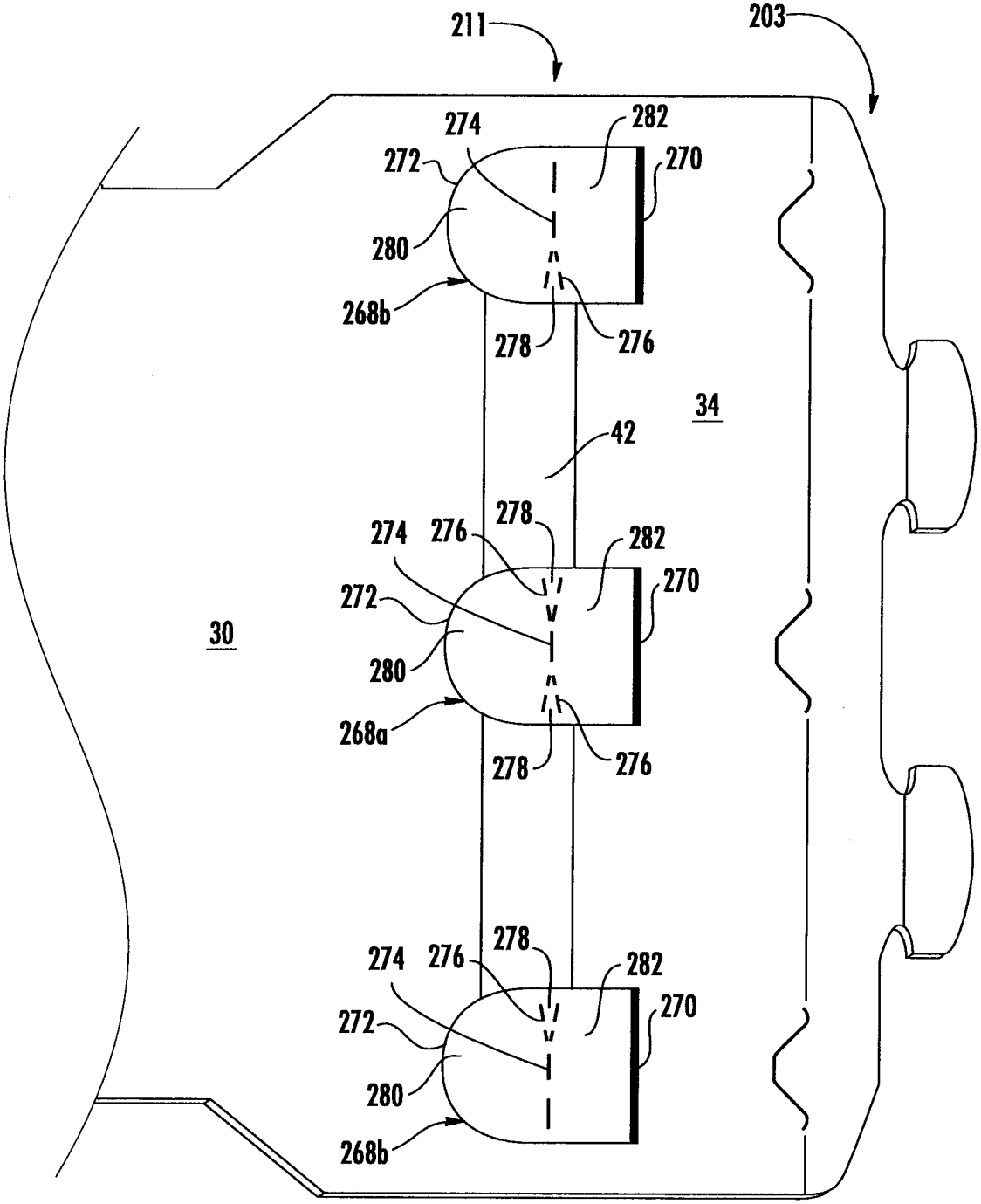

As shown in FIGS. 8A and 8B, an intermediate portion 278 is defined by each of the fold lines 276 and an adjacent portion of the respective cut line 272. Each intermediate portion 278 may be generally triangular shaped, parabolic, or semicircular depending on any desired shape of the fold line 276. Each of the retention tabs 264*a*, 264*b*, 268*a*, 268*b* can also comprise a distal portion 280 foldably connected to a proximal portion 282 along the lateral fold line 274 and fold lines 276. In the illustrated embodiment, each of the retention tabs 264*a*, 264*b*, 268*a*, 268*b* is positioned to engage at least a portion of a rim R of a dome feature D at the bottom B of a respective container C through a biasing force provided through intermediate portions 278. Alternatively, the retention tabs 264*a*, 264*b*, 268*a*, 268*b* can be omitted or otherwise shaped, arranged, positioned, and/or configured without departing from the disclosure. Also, the blank 203 could be otherwise shaped, arranged, and/or configured without departing from the disclosure.

In general, the blanks according to the present disclosure can be constructed from paperboard having a caliper so that it is heavier and more rigid than ordinary paper. The blanks can also be constructed of other materials, such as cardboard, or any other material having properties suitable for enabling the carton to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for carrying a plurality of articles, the carton comprising:

a plurality of panels at least partially extending around an interior of the carton, the plurality of panels comprising at least one bottom panel and at least one side panel foldably connected to the bottom panel;

at least one retention tab foldably connected to the at least one bottom panel, the at least one retention tab being for engaging at least a portion of an article of the plurality of articles, the at least one retention tab comprises a first portion proximate and foldably connected to the bottom panel at a first fold line, a second portion proximate and foldably connected to the first portion at a second fold line, a first intermediate portion between the first portion and the second portion, and a second intermediate portion between the first portion and the second portion;

the first intermediate portion being at least partially defined by a third fold line, the second intermediate portion being at least partially defined by a fourth fold line, and the first intermediate portion and the second intermediate portion are arranged to provide a biasing force to the second portion to engage a respective article of the plurality of articles.

2. The carton of claim 1, wherein the second portion is folded relative to the first portion to engage a respective article of the plurality of articles.

3. The carton of claim 1, wherein the second fold line is a lateral fold line extending across at least a portion of the at least one retention tab.

4. The carton of claim 1, wherein the third fold line is a fold line that foldably connects the first intermediate portion to the first portion and the second portion.

5. The carton of claim 1, wherein the third fold line has a first portion connecting the first intermediate portion to the first portion of the at least one retention tab and a second portion connecting the first intermediate portion to the second portion of the at least one retention tab.

6. The carton of claim 5, wherein the fourth fold line is a bifurcated fold line extending from the second fold line.

7. The carton of claim 1, wherein the third fold line is a bifurcated fold line extending from the second fold line.

8. The carton of claim 1, wherein the third fold line is an arcuate fold line with a medial portion proximate the second fold line.

9. The carton of claim 1, wherein the first intermediate portion and second intermediate portion are generally triangular shaped.

10. The carton of claim 1, wherein the second fold line is a lateral fold line extending from the third fold line to substantially proximate an edge of the at least one retention tab.

11. The carton of claim 1, wherein the first portion is a proximal portion generally adjacent the at least one bottom panel and the second portion is a distal portion comprising a free edge of the at least one retention tab.

12. The carton of claim 1, wherein the at least one side panel comprises a first side panel and a second side panel, the at least one bottom panel comprises a first bottom panel foldably connected to the first side panel and a second bottom panel foldably connected to the second side panel, and plurality of panels comprises a top panel foldably connected to the first side panel and the second side panel.

13. The carton of claim 12, wherein the carton is configured to have open ends.

14. The carton of claim 13, further comprising at least one top retainer foldably connected to at least the top panel, the at least one top retainer being for engaging a portion of an outer circumference of an article of the plurality of articles.

15. The carton of 14, wherein the at least one top retainer includes a side retention panel foldably connected to the top panel at a first oblique fold line and a tuck-in panel foldably connected to one of the first side panel and the second side panel at a second oblique fold line.

16. A blank for forming a carton, the blank comprising:

a plurality of panels comprising at least one bottom panel and at least one side panel foldably connected to the bottom panel; and at least one retention tab foldably connected to the at least one bottom panel, the at least one retention tab being for engaging at least a portion of an article, the at least one retention tab comprises a first portion proximate and foldably connected to the bottom panel at a first fold line, a second portion proximate and foldably connected to the first portion at a second fold line, a first intermediate portion between the first portion and the second portion, and a second intermediate portion between the first portion and the second portion, the first intermediate portion being at least partially defined by a third fold line, and the second intermediate portion being at least partially defined by a fourth fold line, the first intermediate portion and the second intermediate portion are for being arranged to provide a biasing force to the second portion to engage a respective article of a plurality of articles in the carton formed from the blank.

17. The blank of claim 16, wherein the second fold line is a lateral fold line extending across at least a portion of the at least one retention tab.

18. The blank of claim 16, wherein the third fold line is a fold line that foldably connects the first intermediate portion to the first portion and the second portion.

19. The blank of claim 16, wherein the third fold line has a first portion connecting the first intermediate portion to the first portion of the at least one retention tab and a second portion connecting the first intermediate portion to the second portion of the at least one retention tab.

20. The blank of claim 16, wherein the third fold line is a bifurcated fold line extending from the second fold line.

21. The blank of claim 16, wherein the third fold line is an arcuate fold line with a medial portion proximate the second fold line.

22. The blank of claim 16, wherein the fourth fold line is a bifurcated fold line extending from the second fold line.

23. The blank of claim 16, wherein the first intermediate portion and second intermediate portion are generally triangular shaped.

24. The blank of claim 16, wherein the second fold line is a lateral fold line extending from the third fold line to substantially proximate an edge of the at least one retention tab.

25. The blank of claim 16, wherein the first portion is a proximal portion generally adjacent the at least one bottom panel and the second portion is a distal portion comprising a free edge of the at least one retention tab.

26. The blank of claim 16, wherein the at least one side panel comprises a first side panel and a second side panel, the at least one bottom panel comprises a first bottom panel foldably connected to the first side panel and a second bottom panel foldably connected to the second side panel, and plurality of panels comprises a top panel foldably connected to the first side panel and the second side panel.

27. The blank of claim 26, further comprising at least one top retainer foldably connected to at least the top panel, the at least one top retainer being for engaging a portion of an outer circumference of an article.

28. The blank of claim 27, wherein the at least one top retainer includes a side retention panel foldably connected to the top panel at a first oblique fold line and a tuck-in panel foldably connected to one of the first side panel and the second side panel at a second oblique fold line.

29. A method of forming a carton for carrying a plurality of articles, the method comprising:

obtaining a blank comprising a plurality of panels comprising at least one bottom panel, at least one side panel foldably connected to the bottom panel, and at least one retention tab foldably connected to the at least one bottom panel, wherein the at least one retention tab comprises a first portion proximate and foldably connected to the bottom panel at a first fold line, a second portion proximate and foldably connected to the first portion at a second fold line, a first intermediate portion between the first portion and the second portion, and a second intermediate portion between the first portion and the second portion; the first intermediate portion being at least partially defined by a third fold line, the second intermediate portion being at least partially defined by a fourth fold line;

forming at least a portion of an interior of the carton by folding the at least one side panel relative to the at least one bottom panel; and positioning the retention tab for engaging at least a portion of an article of the plurality of articles comprising folding the second portion relative to the first portion to engage a respective article of the plurality of articles and folding the first intermediate portion along the third fold line and the second intermediate portion along the fourth fold line, wherein the first intermediate portion and the second intermediate portion are arranged to provide a biasing force to the second portion to engage a respective article of the plurality of articles.

30. The method of claim 29, wherein:

the third fold line has a first portion connecting the first intermediate portion to the first portion of the at least one retention tab and a second portion connecting the first intermediate portion to the second portion of the at least one retention tab; and positioning the retention tab comprises folding the first intermediate portion along the first portion of the third fold line and along the second portion of the third fold line.

31. The method of claim 29, wherein:

the at least one side panel comprises a first side panel and a second side panel, the at least one bottom panel comprises a first bottom panel foldably connected to the first side panel and a second bottom panel foldably connected to the second side panel, and plurality of panels comprises a top panel foldably connected to the first side panel and the second side panel; and forming at least the portion of the interior of the carton comprises folding the second side panel relative to the second bottom panel and folding the top panel relative to the first and second side panels.

32. The method of claim 31, wherein the carton is configured to have open ends.

33. The method of claim 31, wherein:

the blank further comprises at least one top retainer foldably connected to at least the top panel; and the method further comprises positioning the top retainer for engaging a portion of an outer circumference of an article of the plurality of articles.

* * * * *